United States Patent [19]

Garshelis

[11] 3,959,751

[45] May 25, 1976

[54] ELECTROMECHANICAL TRANSDUCER HAVING CIRCULARLY MAGNETIZED HELICALLY WOUND MAGNETOSTRICTIVE ROD

[76] Inventor: Ivan J. Garshelis, 61 Oleander Way, Clark, N.J. 07066

[22] Filed: July 12, 1974

[21] Appl. No.: 488,219

[52] U.S. Cl. ..... 335/3; 335/215; 317/143

[51] Int. Cl.[2] ..... H01H 55/00

[58] Field of Search ..... 335/215, 3, 284; 317/143

[56] References Cited

UNITED STATES PATENTS

| | | | |
|---|---|---|---|
| 2,836,492 | 5/1958 | Clark | 335/215 X |
| 3,015,708 | 1/1962 | Mason | 317/143 X |
| 3,083,353 | 3/1963 | Bobeck | 335/215 X |
| 3,457,463 | 7/1969 | Balamuth | 317/143 X |
| 3,638,153 | 1/1972 | Sparrow | 335/215 |
| 3,753,183 | 8/1973 | Aspinwall et al. | 335/284 |

FOREIGN PATENTS OR APPLICATIONS

| | | | |
|---|---|---|---|
| 941,286 | 7/1948 | France | 335/215 |

*Primary Examiner*—George Harris
*Attorney, Agent, or Firm*—Hubbell, Cohen, Stiefel & Gross

[57] ABSTRACT

Electromechanical transducer comprising a helically wound, magnetostrictive rod that is circularly magnetized. Surrounding said rod is a conductive coil.

20 Claims, 21 Drawing Figures

| | |
|---|---|
| A | 18% Ni Maraging Steel Lightly Cold Drawn |
| B | Ingot Iron Cold Drawn |
| C | Nickel 200 Cold Drawn |
| D | 1.00% C Steel Lightly Cold Drawn |
| E | AISI Type 440C Cold Drawn |
| F | Nickel 200 480° C Anneal |
| G | Nickel 200 900° C Anneal |
| H | Ingot Iron 950° C Anneal |

| CURVE | MATERIAL AND CONDITION | TWIST ± |
|---|---|---|
| A | 1.00% C Steel OQ and T 460° C | 20° |
| B | 18% Ni Maraging Steel Lightly Cold Drawn | 20° |
| C * | 1.25% Steel Lightly Cold Drawn | 20° |
| D | 1.25% Steel 500° C Anneal | 20° |
| E | 52 Alloy Annealed Tubing. | 5° |
| F | Ingot Iron Cold Drawn | 5° |
| G | AISI C1018 Cold Drawn | 10° |
| H | Ingot Iron Cold Drawn | 15° |
| I | Nickel 200 Cold Drawn 430° C Anneal | 5° |

* After $10^6$ cycles at ±15°

ELECTROMECHANICAL TRANSDUCER HAVING CIRCULARLY MAGNETIZED HELICALLY WOUND MAGNETOSTRICTIVE ROD

RELATED APPLICATIONS

This application is related to four applications filed by me of even date which are entitled Magnetoelastic, Remanent, Hysteritic Devices, Ser. No. 488,208, Electromagnetic Anisotropic Devices, Ser. No. 488,209, Mechanical Magnet, Ser. No. 488,841, and Method and Apparatus for Circularly Magnetizing a Helical Conductive Rod, Ser. No. 488,220, the contents of all of which are hereby incorporated by reference in their entireties.

BACKGROUND OF THE INVENTION

1. Field of the Invention

This invention relates to transducers and particularly to electromechanical transducers. More particularly this invention relates to devices capable of transducing an alternating current input into an oscillating mechanical output, or vice versa, or capable of producing a predetermined unidirectional mechanical movement in response to a DC input, or of producing a unidirectional electrical pulse in response to a predetermined mechanical movement.

2. The Prior Art

For many years the so called Wiedemann effect has been well known. The Wiedemann effect is the twist produced in a wire that exhibits magnetostriction when that wire is placed in a longitudinal magnetic field and a current flows through the wire. The converse or inverse of this has also been long recognized and is commonly called the Inverse Wiedemann Effect. In the Inverse Wiedemann Effect axial magnetization is produced by a magnetostrictive wire that carries current therethrough when the wire is twisted.

There have been a number of attempts to employ the Wiedemann and Inverse Wiedemann Effects in practical applications. Such attempts are discussed at length in an article by J. A. Granath entitled Instrumentation Applications of Inverse Wiedemann Effect which appeared in the Journal of Applied Physics, Vol. 31, pp. 178S–180S (May 1961), and in a publication by the International Nickel Company, Inc. of New York, New York entitled Magnetostriction. At least two U.S. Patents disclose devices relying upon the Inverse Wiedemann Effect, namely U.S. Pat. No. 2,511,178 granted to H. C. Roters on June 13, 1950, and U.S. Pat. No. 3,083,353 granted to A. H. Bobeck on Mar. 26, 1963.

SUMMARY OF THE INVENTION

A magnetostrictive rod is formed into a helical coil. Wound about the helically coiled rod is a coiled conductor. The rod is either permanently circularly magnetized or is capable of conducting an electric current therethrough. If the rod is mechanically axially deformed, a voltage will appear across the output terminals of the coiled conductor wrapped thereabout. Conversely if a voltage is applied to the terminals of the coiled conductor, the coiled rod will deform in the axial direction.

This being the case, the device can serve as either an AC or a DC transducer and can produce either an electrical or mechanical output depending upon whether the input is mechanical or electrical, respectively. Thus, for example, if an alternating current voltage is applied to the terminals of the conductor wound about the magnetostrictive rod and if a magnetic field is present, either due to permanent circular magnetization of the rod or due to a DC current flowing through the coiled rod, the rod will tend to twist or untwist in accordance with the Inverse Weidemann Effect. Since the rod is in the form of a helical coil, however, the twisting or untwisting output is converted into a longitudinal displacement of the two ends of the coiled rod which displacement will be oscillatory in the case just hypothesized. Clearly, the inverse holds as well. That is to say, given the same situation, if an oscillating mechanical input is applied to the coiled rod, an AC signal will appear across the terminals of the conductive coil disposed around the rod.

Similarly, if a DC voltage is applied to the coiled rod, the coiled rod will become either axially longer or smaller depending upon the polarity of the signal applied to the coil. Inversely, if the coiled rod is mechanically deformed to either elongate or compress it, a signle unidirectional electrical pulse will be produced across the terminals of the conductive coil wound on the rod.

DETAILED DESCRIPTION OF THE PREFERRED EMBODIMENTS

Figure 13:
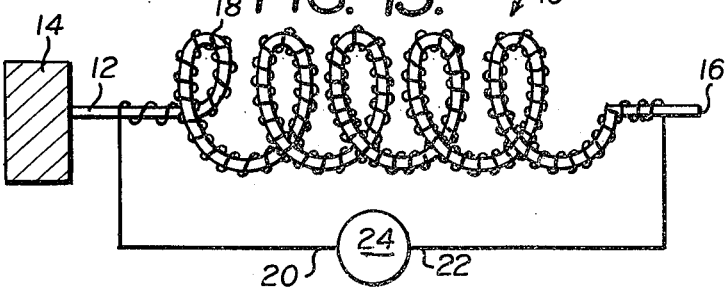
FIG. 13 is a diagrammatic view of a transducer for producing a mechanical output in response to an electrical input embodying the present invention wherein the coiled rod is permanently circularly magnetized.

The transducer 10 of FIG. 13 is a device for producing a mechanical output in response to an electrical input. The device 10 of FIG. 13 comprises a helically wound rod 12 fixed at one end 14 relative to its other end 16. Wound about the helically wound rod is a conductive coil, preferably of fine copper wire, which coil is shown to be wound about the individual turns of the coiled rod 12, the conductive coil being designated by the reference numeral 18. The terminals 20 and 22 of the conductive coil 18 are connected to a suitable voltage source 24 which, as will be seen hereinafter, may be either an AC or a DC source. Mechanical output will be realized in terms of relative axial movement between the ends 14 and 16 of the coiled rod 12.

Throughout this specification and the claims annexed hereto, the coiled member 12 will be referred to as a "rod". However, it will be understood that as used herein, the term "rod" will include hollow tubular members as well as solid members. Moreover, while the rod is commonly referred to as "helically coiled" or "helically wound" the form of the winding of the rod is not one of mathematical precision and any generally helical configuration will be satisfactory. Also, as noted hereinafter, the helix need not be one whose outer envelope defines a cylinder. The helix may be tapered or it may be in the form of a flat spiral wherein all of the turns are disposed in a single plane. The rod 12 must be magnetostrictive and exhibit the magnetic quality of remanence. Preferably the rod will exhibit a high coefficient of magnetostriction, high magnetic saturation, high remanence, good mechanical strength and low mechanical fatigue. By high remanence is meant remanence which will not be erased either by the current flowing through the electrically conductive coil 18 or by mechanical distortion of the rod 12. Excellent results have been achieved when the rod is made from iron-cobalt alloys such as 30% iron and 70% cobalt or 48% iron, 48% cobalt and 4% vanadium. Excellent results have also been obtained from maraging steels such as, for example, a maraging steel composed of 18% nickel, 9% cobalt, 5% molybdenum, 1% titanium and 67% iron.

To permanently circularly magnetize the rod 12, a direct current is passed therethrough. If the rod is tubular, circular magnetization can be obtained by disposing a conductor within the tube and passing a unidirectional current through said conductor. Application of the Biot-Savart Law will demonstrate that it is not possible by any means to obtain a uniform magnetizing field across the entire section of a solid rod 12. However, relatively uniform induction can be expected over any designated fraction F of the total area of a solid rod, which fraction may be preselected by the designer. The interrelationship of the magnetizing current and the fraction F having relatively uniform magnetization is governed by the expression $i = 5ro\ Hmin/\sqrt{1 - F}$ Applying this equation, it will be seen that to produce a minimum field (Hmin) of 100 oersteds over a fraction (F) of 99% of the total area of a solid rod of radius equal to about 1.59 mm, a current of 800 amperes is required. Currents of this order of magnitude are desirably obtained in the form of single pulses of half cycles 60 hertz sign waves in order to avoid unwanted heating effects.

With a device of FIG. 13 so constructed, if voltage source 24 is an AC source, as the current flows through conductive coil 18, coiled rod 2 will tend to twist, which twist will be translated into an axial deformation of coiled rod 12 so that end 16 will vibrate relative to end 14 in response to the wave form of the voltage applied by source 24. Depending upon the frequency of the AC signal applied by the source 24, a number of interesting applications for the device 10 of FIG. 13 will suggest themselves. Thus, for example, if the frequency is low, the device could be employed to ring bells, a striker being affixed to the end 16, or to operate fluid pumps or the like. If the frequencies of the signals from source 24 are in the audio range, then the device could function to drive a speaker cone or the like.

One of the great advantages of employing a helically coiled rod 12 in such applications, when compared with the straight rods of the prior art, is that in a vibratory system, the ratio of spring constant to mass can be carefully tailored to a predetermined desired frequency. In this connection, the spring constant K is much lower in a coil than in a straight rod thereby giving an opportunity to use the Inverse Wiedemann Effect in a whole range of applications not heretofore available. In addition, the device 10 is far more compact than straight rod devices yielding similar results. This is due to the fact that the same length of rod occupies a shorter space when helically wound than when straight. Yet the two rods will exhibit the same amount of twist when subjected to the same conditions.

Figure 14:
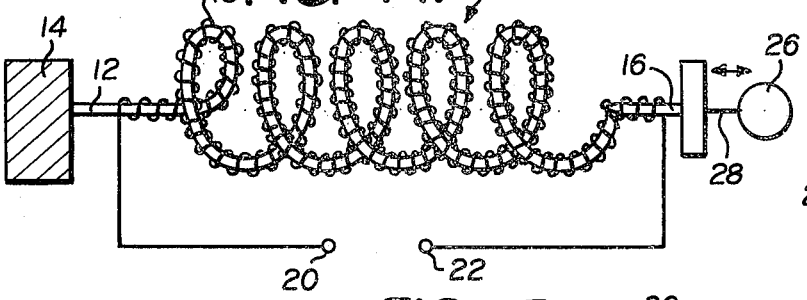
FIG. 14 is a diagrammatic view of a transducer for producing an electrical signal in response to a mechanical input embodying the present invention wherein the coil rod is permanently circularly magnetized.

Referring now to FIG. 14, the transducer 10' is essentially identical to the transducer 10. However, it is connected to produce an electrical output in response to a mechanical input. The mechanical input may be derived from any source of mechanical movement 26 which will operate through a satisfactory mechanical connection 28 on the end 16 of the rod 12. Given mechanical movement, an electrical signal will appear between the terminals 20 and 22 of the conductive coil 18. If the mechanical movement applied to the end 16 is vibratory in nature, then the electrical signal appearing across the terminals 20 and 22 will be alternating with the wave form being a function of the mechanical wave form of the mechanical input. Thus the device 10' may be employed as an instrument for the detection of vibration, as a phonograph pickup, or as a microphone. The device may also be employed as an essentially frictionless electric generator for generating pulses to power flashing lights on marine buoys or the like or, in the alternative, to charging a battery which powers the lights on such buoys. In such an application the movement of the buoy can readily be translated into a mechanical input to the end 16 of the coiled rod 12 to generate suitable power output at the terminals 20 and 22.

The device 10' is also useful to generate a unidirectional electric pulse at the terminals 20 and 22. This, of course, will occur if there is movement in only one direction being detected by the end 16. Thus, for example, if the device 10' is connected to a window or a door for the purpose of detecting the opening of such window or door, upon the opening, there will be movement in a predetermined direction which will deform coiled rod 12 in a predetermined direction either to lengthen or to compress it. When this occurs a single unidirectional electrical pulse will appear across the terminals 20 and 22 which pulse may be employed to actuate a suitable relay means such as an electromagnetic relay with a holding circuit or an SCR or the like to sound an alarm. Again, a compact reliable frictionless device is obtained and by utilizing a coiled rod instead of a straight rod much less mechanical force is required to deform the coil and hence twist and untwist its respective convolutions to produce a given voltage output than would be required if the rod were a straight, uncoiled rod.

Figure 15:
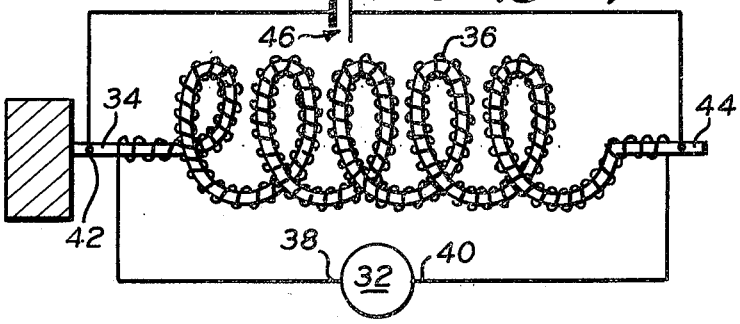
FIG. 15 is a diagrammatic view similar to FIG. 13 wherein circular magnetization of the coiled rod is obtained by passing a direct current therethrough.
Figure 16:
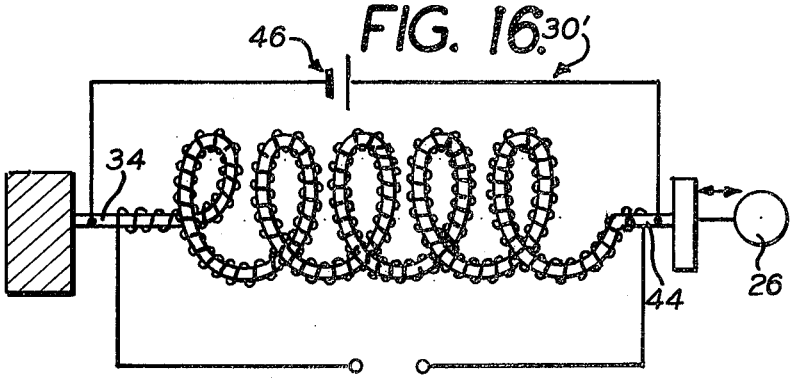
FIG. 16 is a diagrammatic view similar to FIG. 14 wherein the circular magnetization of the coiled rod is obtained by passing a direct current therethrough.

The transducers 10 and 10' described above both rely on permanent circular magnetization. In the tranducers of FIGS. 15 and 16, the circular magnetization is achieved by the application of a unidirectional current to the coil rod. This being the case, in the embodiments of FIGS. 15 and 16, it is not desirable that the rods exhibit any significant remanence. However, it is desirable that the rod have a low electrical resistance whereby to permit relatively high currents to pass therethrough without undue resistance losses in the coiled rod. Moreover, when relying on an electric current to produce the circular magnetization the material must exhibit magnetic susceptibility, and preferably high magnetic susceptibility. Conversely, in the embodiments of FIGS. 13 and 14, it is preferred that the magnetic susceptibility be low.

Referring now to FIG. 15, the transducer 30 is arranged to produce a mechanical output in response to an electrical source 32. The transducer 30 comprises a helically coiled rod 34 that exhibits magnetostriction and is electrically conductive and magnetically susceptible. Wound about the turns of the helically rod 34 is a conductive coil 36 preferably made of copper or similar highly conductive material. The conductive coil 36 has terminals 38 and 40. Finally, applied to the two ends 42 and 44 of the rod 34 are terminals of a DC source here shown diagrammatically as a battery 46. The current flowing through the rod 34 by virtue of the application of the voltage from the source 46 will provide a circular magnetic field that is in all respects equivalent to the remanent circular magnetization of the embodiments of the invention shown in FIGS. 13 and 14. The practical applications for the transducer 30 of FIG. 15 are essentially the same as those heretofore set forth in respect to the transducer 10 of FIG. 13.

Referring now to FIG. 16, the inverse of transducer 30 is shown which transducer is designated by the reference numeral 30'. This transducer relies on a direct current from a suitable source such as battery 46 instead of the permanent magnetization stemming from a high remanence of rod 34. Mechanical input would come from any suitable mechanical movement 26 which is connected to the end 44.

Figure 17:
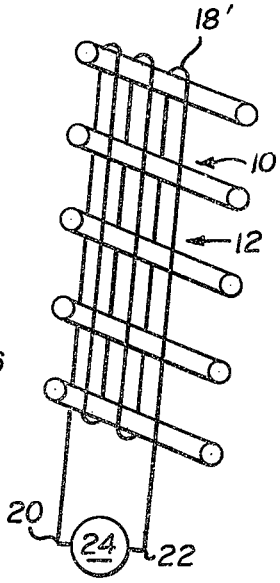
FIG. 17 is a longitudinal sectional view of a transducer embodying the present invention wherein the coil is wound about the entire coiled rod.

Referring now to FIG. 17, a modified transducer of the type shown in FIG. 13 is illustrated. The transducer of FIG. 17 is in all respects the same as the FIG. 13 embodiment save that the coil 18', which is wound about the coiled rod 12, does not have its turns surrounding a single turn or convolution of the coiled rod 12, but instead it surrounds a plurality of said turns of coiled rod 12, here shown to be all of the turns of the coiled rod. The input terminals 20 and 22 of the modified coil 18' are connected to a suitable source of AC 24. The device of FIG. 17 will function precisely as does the device of FIG. 13 as it will be clear to anyone having read the specification that the number of axial flux linkage and $d\phi/dt$ will be the same in both embodiments. A similar modification may be made for the other transducers heretofore described in connection with FIGS. 14, 15 and 16, but a detailed description of said modifications is deemed unnecessary. Suffice it to say, as the term "wound about the coiled rod" is used herein, it is intended to include wound conductive coils wherein the turns surround a single convolution of the coiled rod or a plurality of such convolutions.

Figure 18:
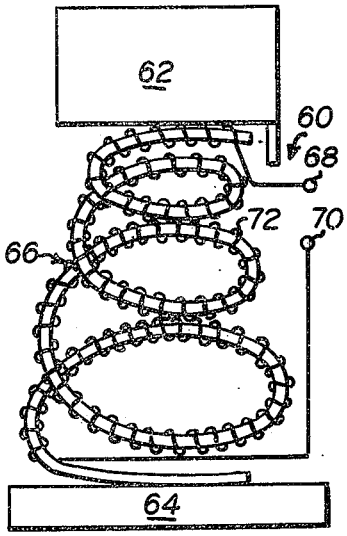
FIG. 18 is a view, partly diagrammatic and partly sectional disclosing a signal generating push button by incorporating a transducer of the present invention wherein the coiled rod is in the form of a tapered coil.

Referring now to FIG. 18, a push button is illustrated for generating an electrical signal in response to the push on the button face 62 of the push button 60. Disposed between the underside of the button face 62 and a base 64 is a helical coil that is in all respects similar to the helical coil 10' of FIG. 14 save for the fact that the coil 66 has a tapered envelope rather than a cylindrical one. This permits greater axial movement during compression of the coil 66 than would be possible for the coil 10' of FIG. 14. Apart from that, the operation of the device 60 will be obvious in light of the preceding description. Suffice it to say, each time the button 62 is pressed, a signal will appear across the output terminals 68 and 70 of the surrounding conductive coil 72, which signal can be employed in connection with an electric typewriter or a mini-calculator or the like.

Figure 1:
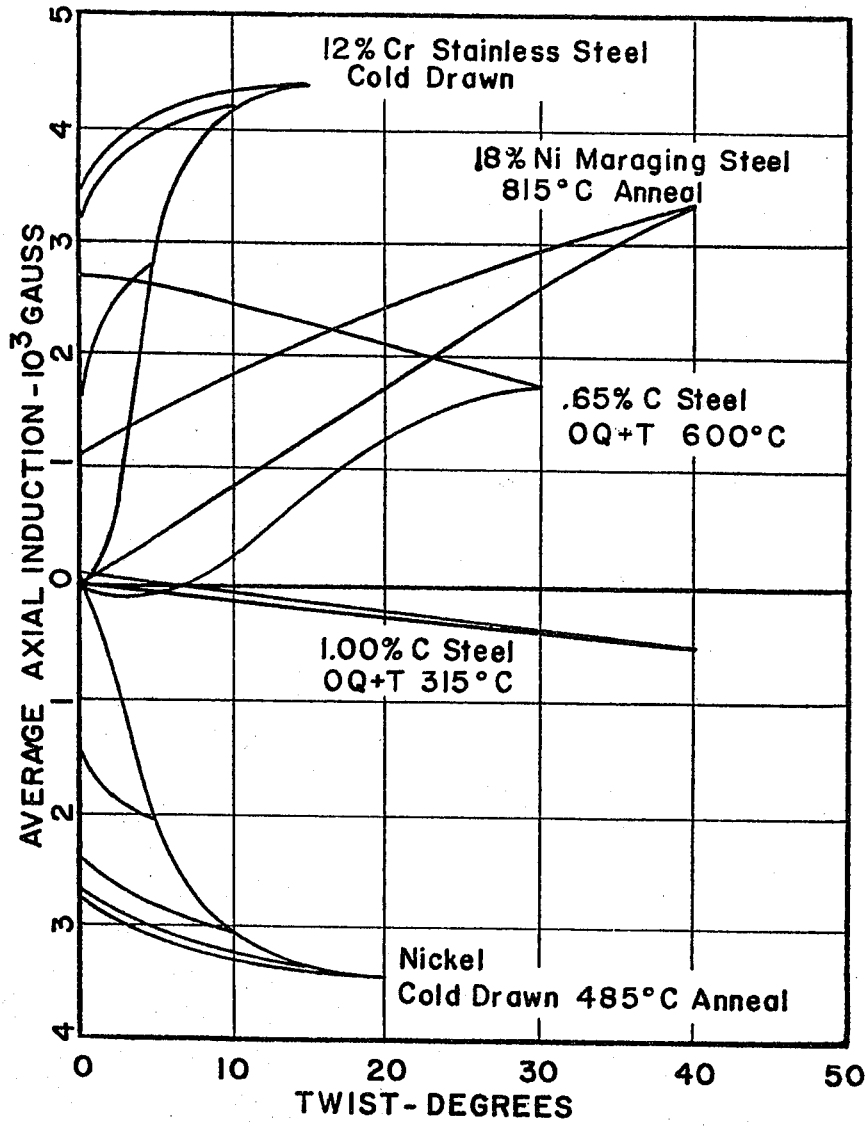
FIG. 1 illustrates a number of graphs for a variety of materials, wherein average axial induction ($B_{-ax}$) is plotted against twist.
Figure 2:
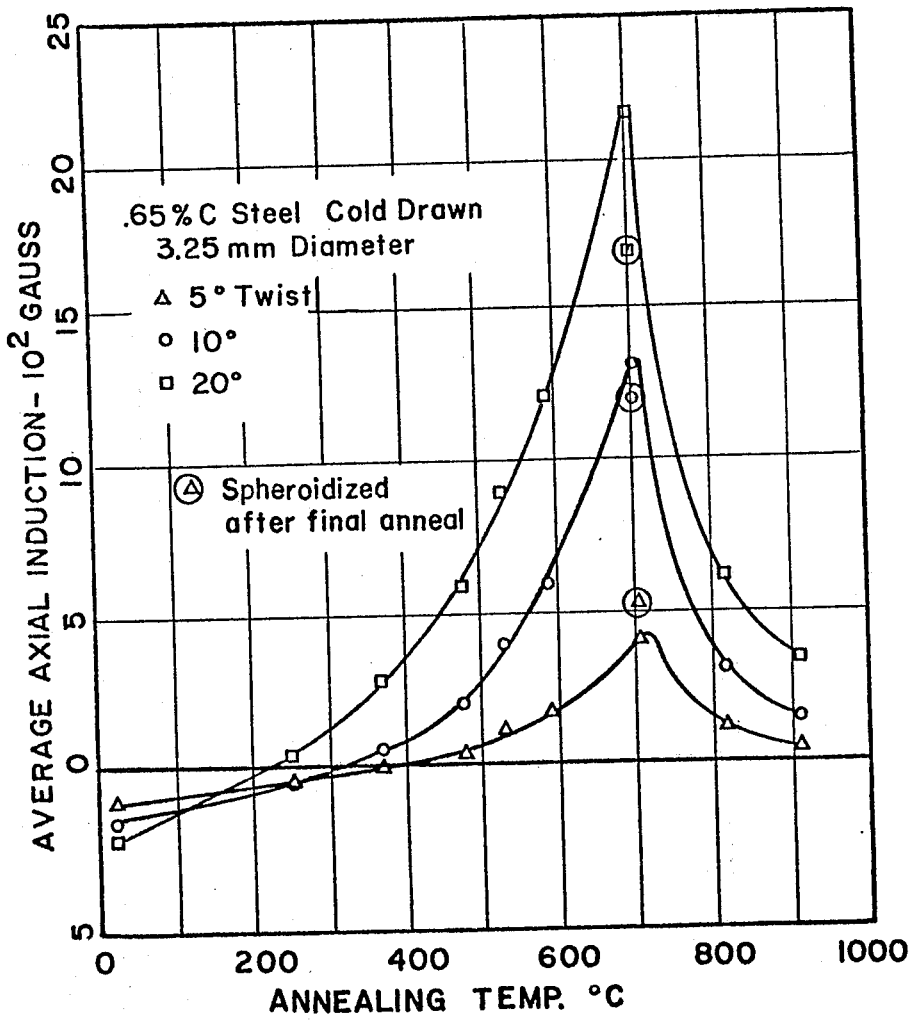
FIG. 2 is a graph illustrating the effect of heat treatment on average axial induction of cold drawn carbon steel, wherein average axial induction for cold drawn steel at different angular twist is plotted against annealing temperature.
Figure 3:
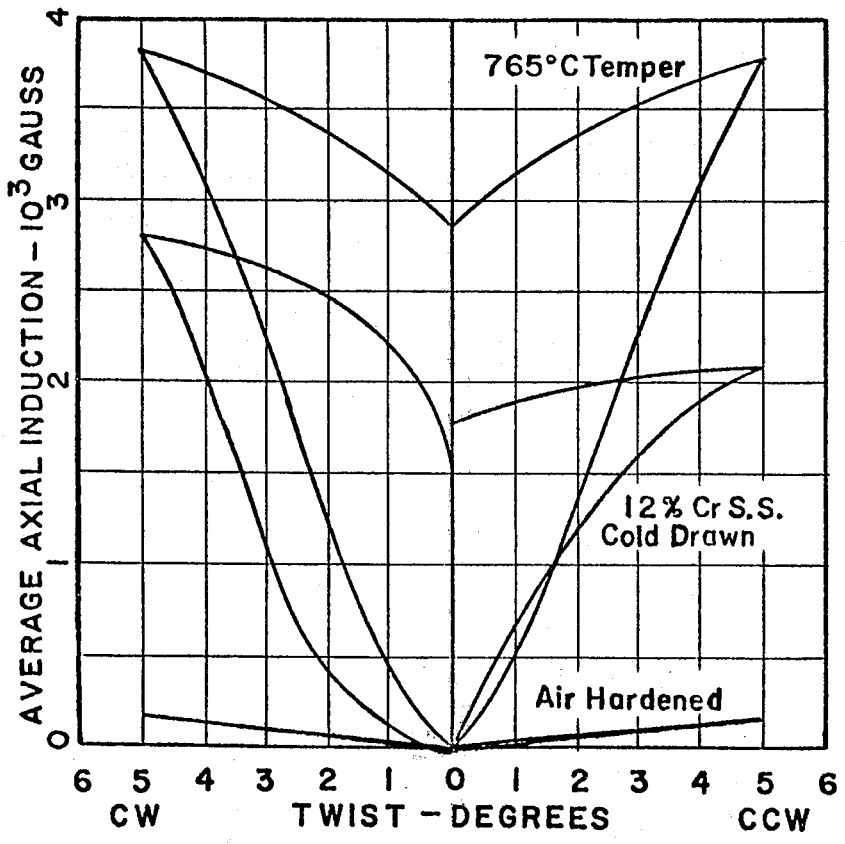
FIG. 3 is a graph showing the effects of hardening and tempering on a symmetry due to torsional overstrain, wherein average axial induction is plotted against twist.
Figure 4:
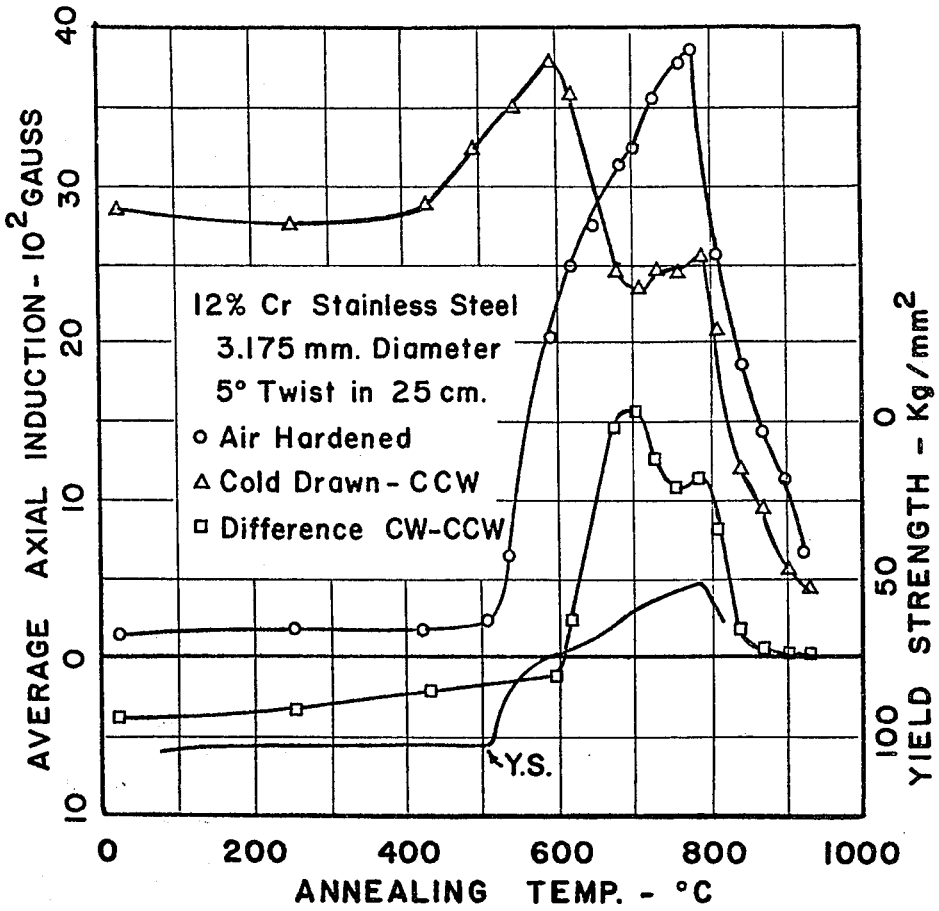
FIG. 4 is a graph illustrating the effect of heat treatment on average axial induction, wherein average axial induction is plotted against annealing temperature.
Figure 5:
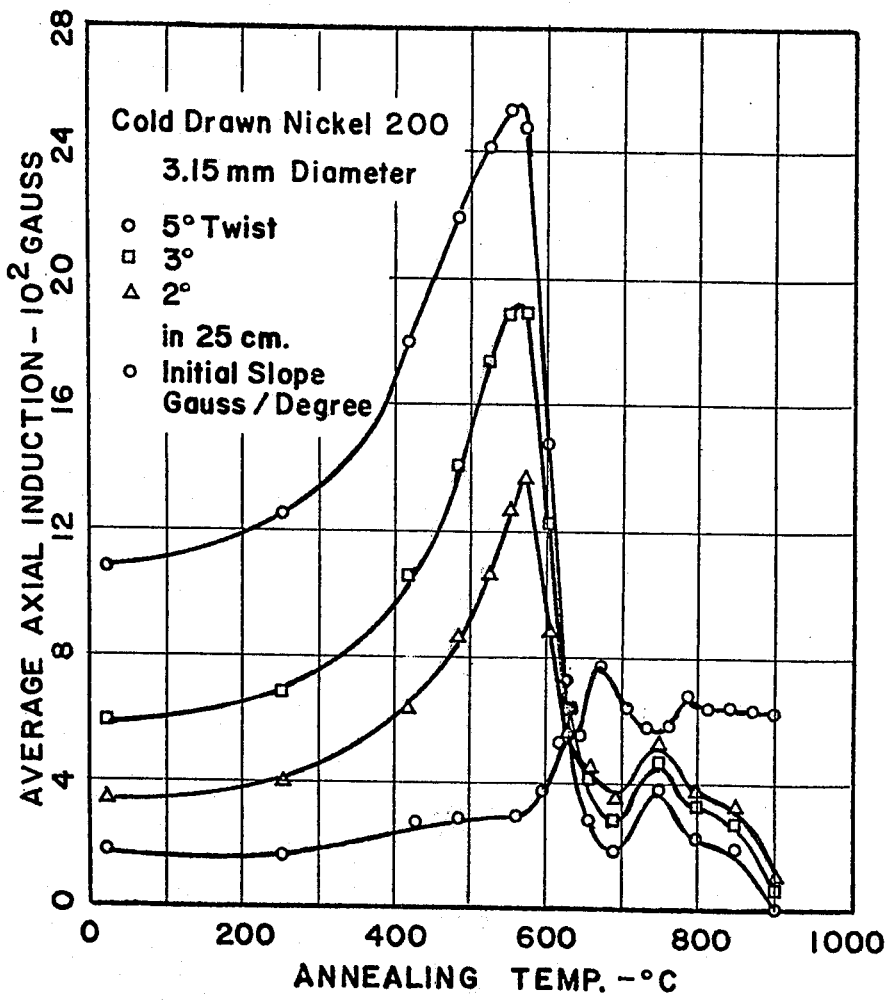
FIG. 5 is a graph illustrating the effect of heat treatment of cold drawn nickel 200 on average axial induction, wherein average axial induction is plotted against annealing temperature.
Figure 6:
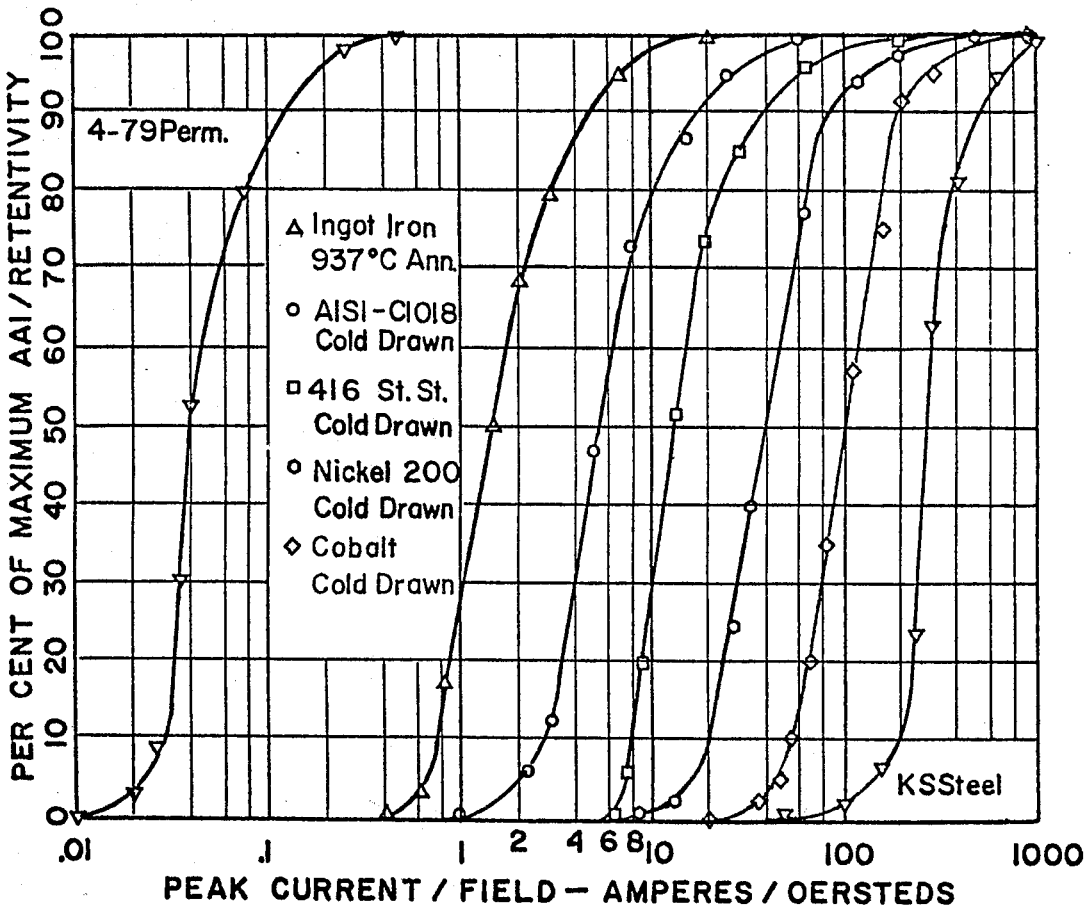
FIG. 6 is a series of graphs illustrating the effect of peak magnetizing current on average axial induction, wherein average axial induction/retentivity is plotted against peak current.
Figure 7:
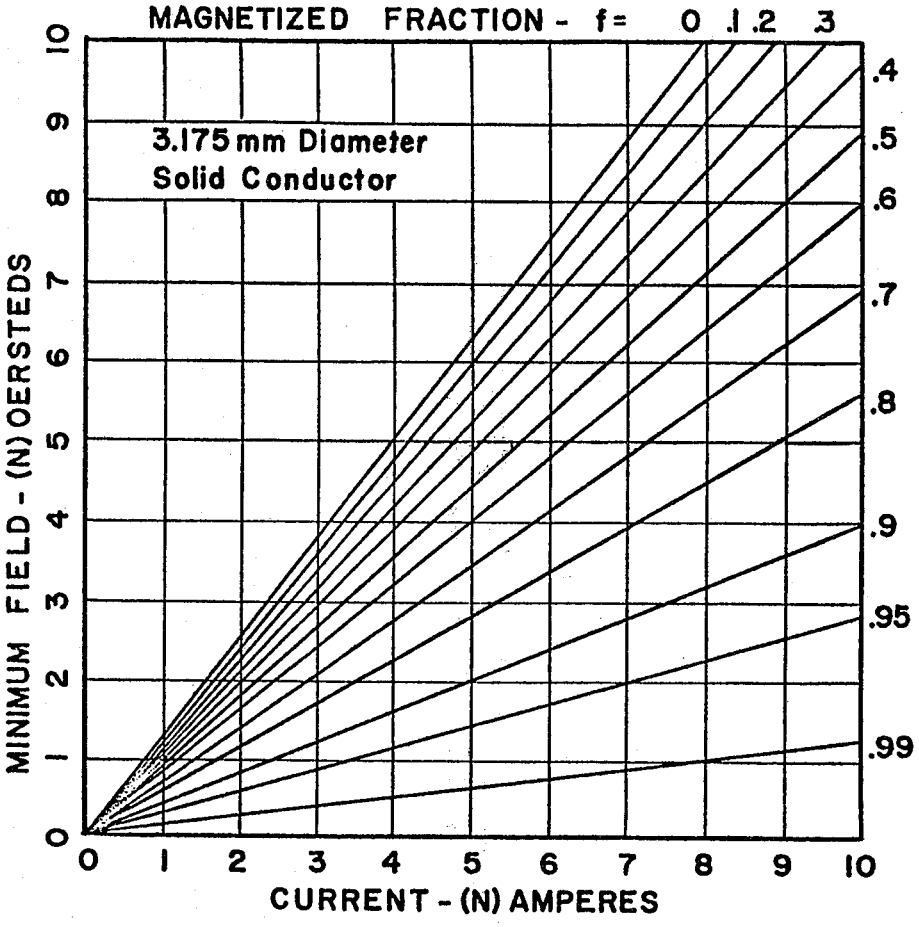
FIG. 7 is a series of graphs illustrating minimum magnetizing field from any current over various fractions of cross-sectional area, wherein minimum field is plotted against current.
Figure 8:
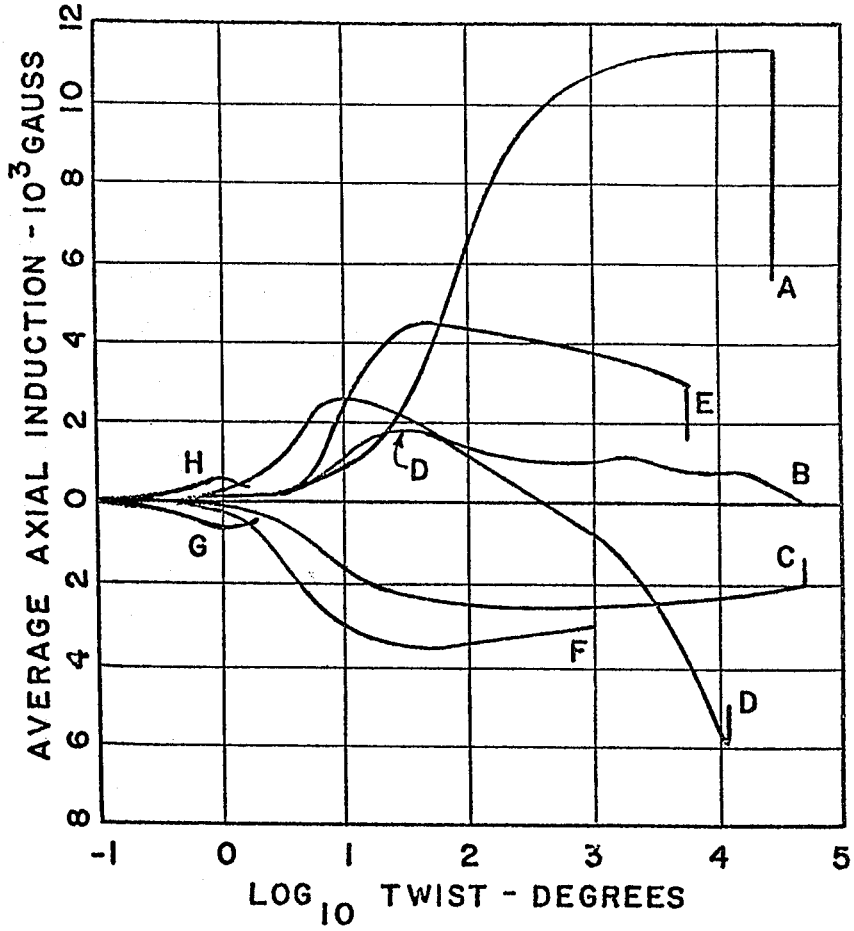
FIG. 8 contains several graphs demonstrating variations in average axial induction above the elastic limit, wherein the average axial induction is plotted against log twist for a variety of materials.
Figure 9:
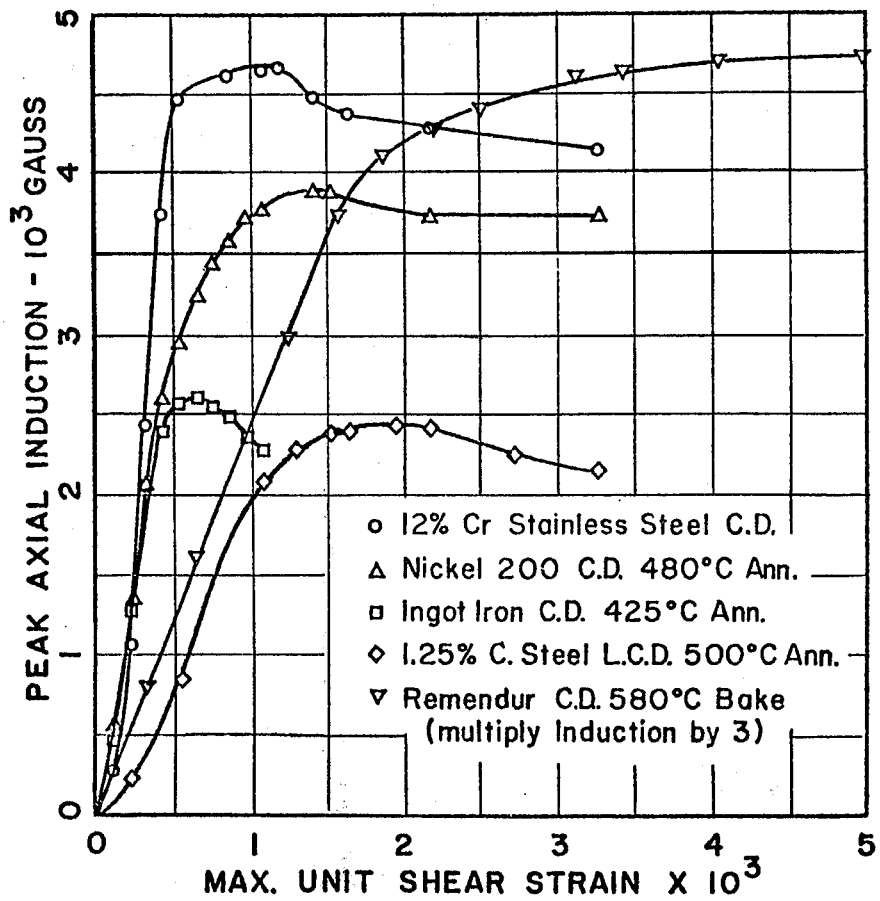
FIG. 9 is a number of graphs showing variations in axial induction with unit shear strain, wherein peak axial induction is plotted against maximum unit shear strain.
Figure 21:
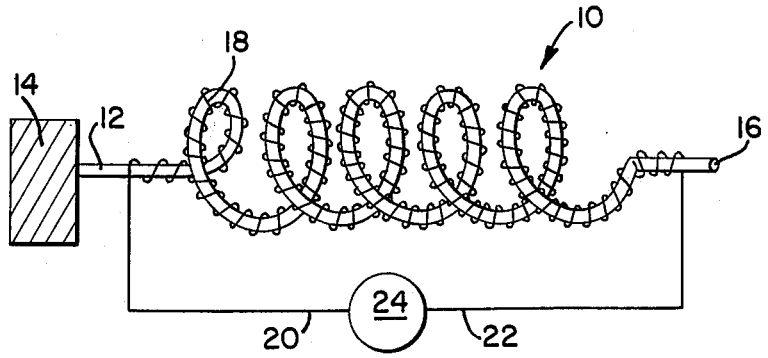
FIG. 21 is a diagrammatic view similar to FIG. 13, but with the rod being shown to be hollow.
Figure 10:
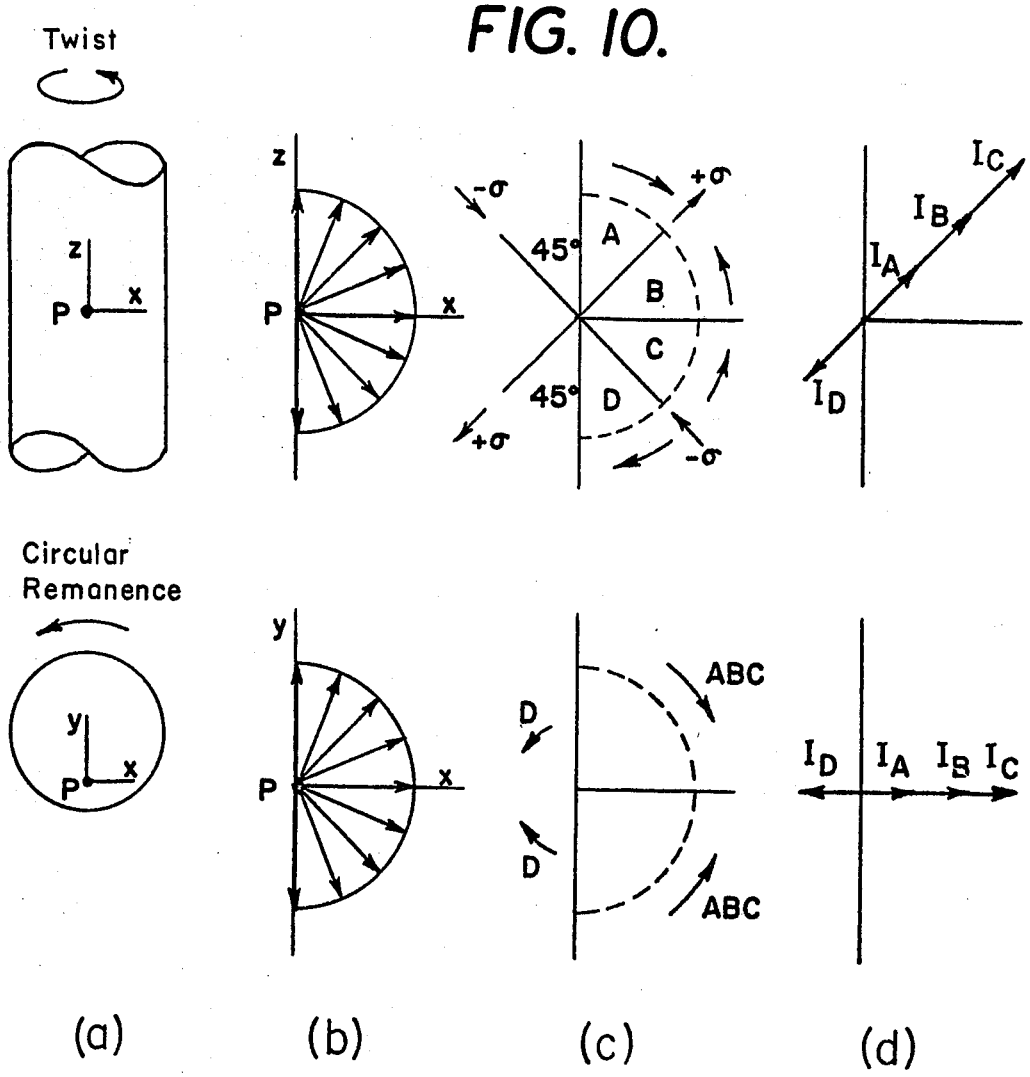
FIG. 10 (*a*), (*b*), (*c*) and (*d*) are diagrammatic views illustrating the reorientation by torsion of circular remanent domains in isotropic material.
Figure 11:
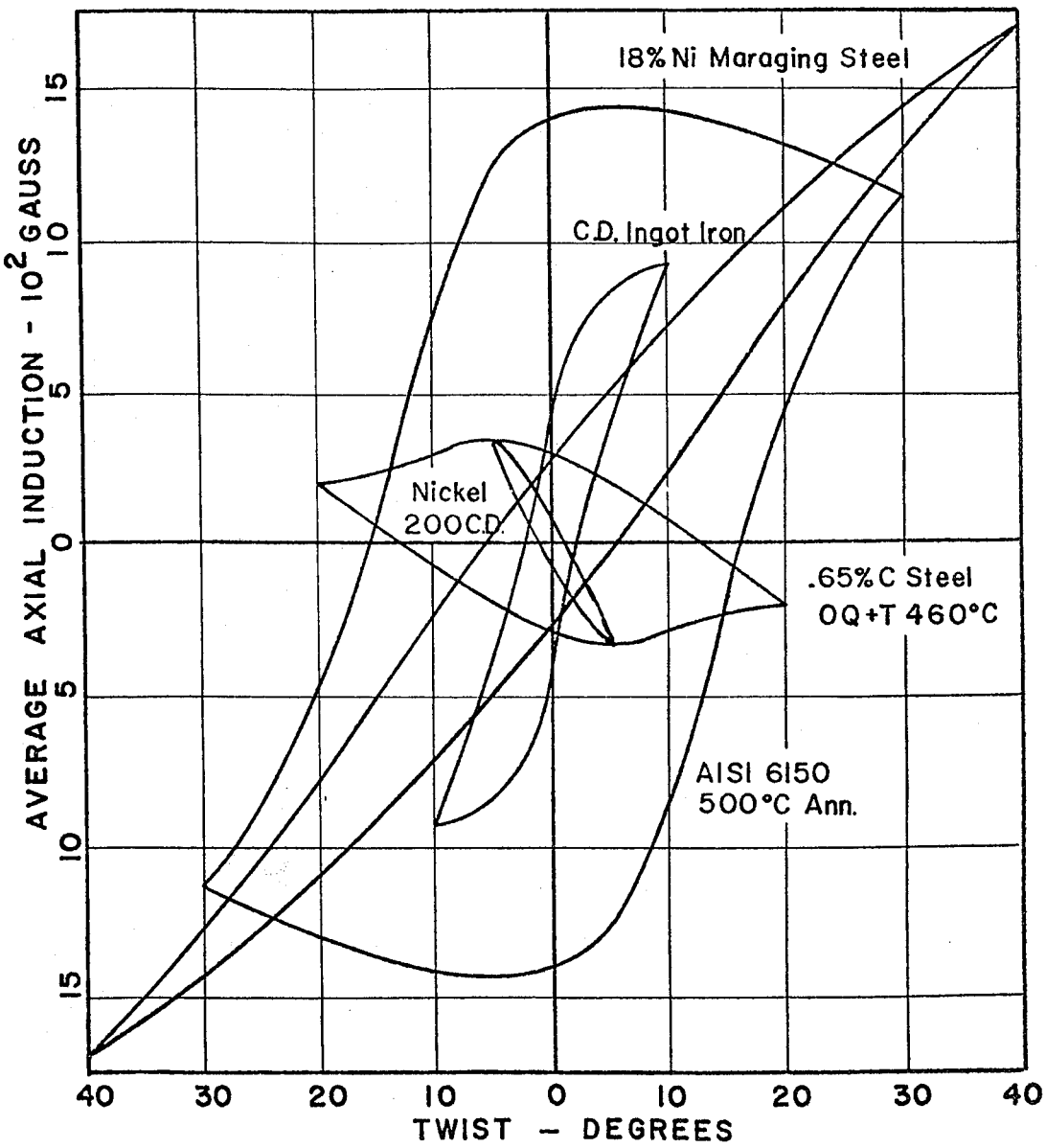
FIG. 11 contains a number of hysteresis curves plotting average axial induction against twist for a variety of materials which have been cycled through said hysteris 100 cycles each.
Figure 12:
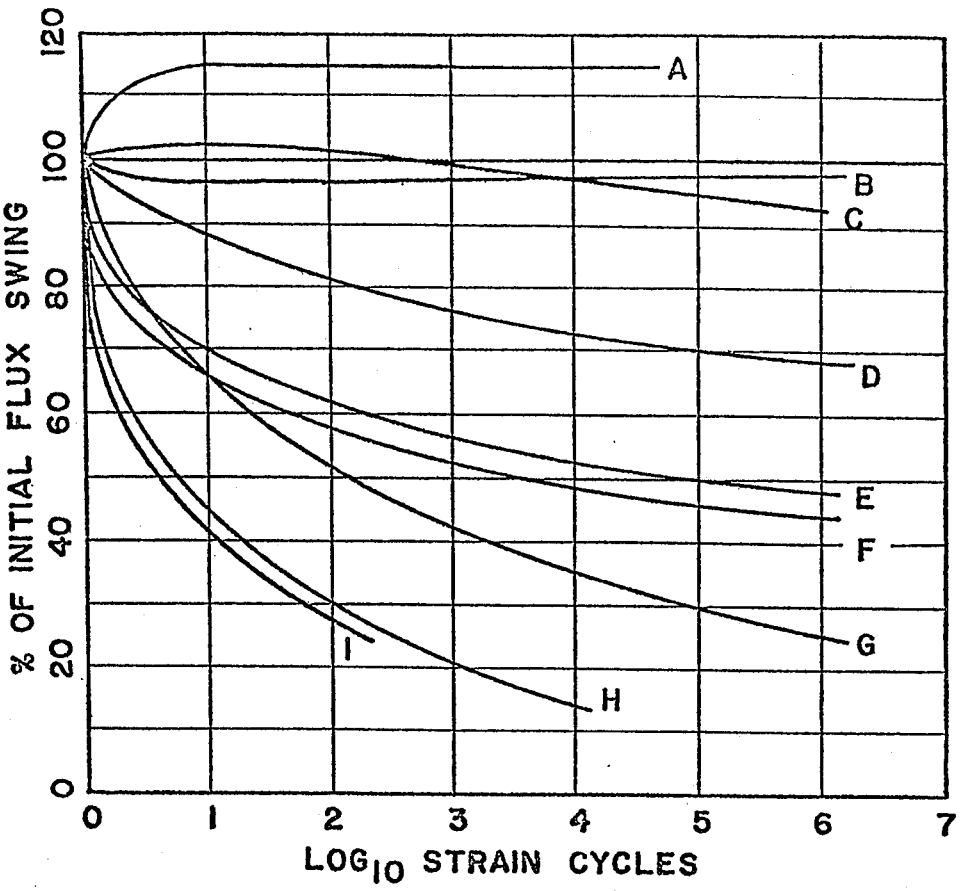
FIG. 12 contains a series of graphs illustrating reptation effects from repeated strain reversals, wherein percentage of initial flux swing is plotted against log strain cycles.
Figure 19:
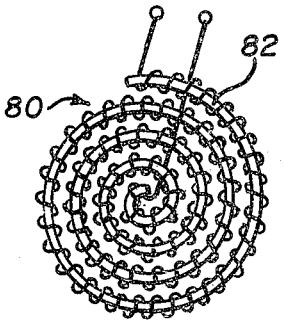
FIG. 19 is a top plan view of yet another form of transducer embodying the present invention.
Figure 20:
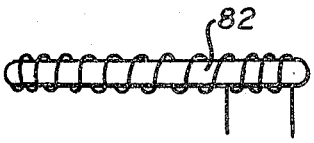
FIG. 20 is a side elevational view of the transducer of FIG. 19.

Still another modification of the present invention is illustrated in FIGS. 19 and 20, wherein the helical rod is wound into the form of a flat helix or planar spiral. The device 80 of FIGS. 19 and 20 is shown as a mechanical to electrical transducer, although, clearly, its operation can be reversed. Moreover, the circular magnetization in the helical rod 82 is provided by remanence in FIGS. 19 and 20, although, clearly, it could be provided by connecting a DC source to the opposite ends of the rod 82. Clearly, distortion of the rod is by the movement of one end out of the plane of the spiral and will ause twist within the rod to produce a voltage. Referring now to FIG. 21, this modification is exactly the same as the FIG. 13 embodiment save for the fact that the rod is a hollow tube as may be seen adjacent the end 16.

The method for circularly magnetizing the helically wound rods described heretofore may be any suitable method. However, it is presently preferred that the method be that described and claimed in my aforementioned co-pending application of even date, Ser. No. 488,220, entitled METHOD AND APPARATUS FOR CIRCULARLY MAGNETIZING A HELICAL ROD, which has already been incorporated herein by reference. The conductive coils disposed about the helical rods of the various embodiments of the present invention may, if desired, be directly wound upon the rods. If this is done, generally speaking, the coiled conductors should first be insulated as by lacquer dipping or the like. In the alternative, and as presently preferred, the coiled conductors are first lacquered dipped and then wound on flexible bobbins. Thereafter, the coiled conductors, together with the bobbins, can be slid onto the helical rods as a unit, thereby to facilitate the assembly of the transducers. Variations in the size and shapes of the rods and coils are a matter of design choice and no particular proportions are believed critical, apart from those already discussed. However, numerous of the experiments with devices of the type herein described, as well as in devices described in my four other applications, have been conducted, wherein the magnetostrictive rods are about 25 to 30 centimeters in length and 3.175 millimeters in diameter. Generally speaking, the number of turns on the conductive coil is a matter of choice, but in the embodiment shown, the number of turns commonly runs the order of magnitude of hundreds to thousands. The theoretical basis for the operation of this invention and of the inventions described in the related applications heretofore referred to and incorporated herein by reference has been presented in a paper which will be published after the filing date of this application, but in July, 1974, by the Institute of Electrical and Electronic Engineers. To enable a fuller understanding of these inventions, the paper was presented as a part of this application as filed and may be found in IEEE Transaction on Magnetics, Mag 10, No. 2, June 1974, pp 344–358.

While I have herein shown the preferred form of the present invention, other changes and modifications may be made herein within the scope of the appended claims without departing from the spirit and scope of this invention.

I claim:

1. An electromechanical transducer comprising:

a circularly magnetized, magnetostrictive, coiled rod; and a conductive coil wound about a portion at least of said coiled rod.

2. The electromechanical transducer as defined in claim 1, wherein said circular magnetization is caused by the magnetic remanence of said rod.

3. The electromechanical transducer as defined in claim 1, wherein said coiled rod is electrically conductive, and further uncluding means on said rod for receiving terminals from a DC source to pair a unidirectional current therethrough, whereby to produce said circular magnetization.

4. The electromechanical transducer as defined in claim 1, wherein said transducer is a mechanical to electrical transducer, further comprising means for moving one end of said rod relative to the other end, and a pair of output terminals for said conductive coil.

5. The electromechanical transducer as defined in claim 4, wherein said means for moving said end of the rod is vibratory, whereby to produce an AC voltage at said output terminals.

6. The electromechanical transducer as defined in claim 4, wherein said means for moving said end of the rod is unidirectional, whereby to produce a unidirectional pulse.

7. The electromechanical transducer as defined in claim 1, wherein said transducer is an electrical to mechanical transducer, and further comprising means for applying a voltage to said conductive coil.

8. The electromechanical transducer as defined in claim 7, wherein said voltage is a DC voltage, whereby to cause a unidirectional relative displacement between the ends of said coiled rod.

9. The electromechanical transducer as defined in claim 7, wherein said voltage is an AC voltage, whereby to cause vibratory relative displacement between the ends of said coiled rod.

10. The electromechanical transducer as defined in claim 1, wherein said coiled rod is solid.

11. The electromechanical transducer as defined in claim 1, wherein said coiled rod is a tube.

12. The electromechanical transducer as defined in claim 1, wherein each turn of said conductive coil surrounds only one turn of said coiled rod.

13. The electromechanical transducer as defined in claim 1, wherein at least a portion of the turns of said conductive coil surround a plurality of turns of said coiled rod.

14. The electromechanical transducer as defined in claim 1, wherein said coiled rod is in the form of a tapered coil.

15. The electromechanical transducer as defined in claim 1, wherein said coiled rod is in the form of a planar spiral.

16. The electromechanical transducer as defined in claim 1, wherein said rod is made of a material that is anhysteritic.

17. The electromechanical transducer as defined in claim 1, wherein said rod is made of a material that exhibits a substantially linear magnetic induction V-twist strain curve.

18. The electromechanical transducer as defined in claim 16, wherein said rod is made of a material that exhibits a substantially linear magnetic induction V-twist strain curve.

19. The electromechanical transducer as defined in claim 1, wherein said rod is made of a material that is hysteresis in its magnetic induction V-twist strain curve.

20. The electromechanical transducer as defined in claim 19, wherein said hysteresis is substantially rectangular.

* * * * *